US007259728B1

(12) United States Patent
Östervall

(10) Patent No.: US 7,259,728 B1
(45) Date of Patent: Aug. 21, 2007

(54) TELESCOPIC RETRACTABLE ANTENNA

(75) Inventor: Torsten Östervall, Stockholm (SE)

(73) Assignee: Laird Technologies, Inc., Lincoln, NE (US)

( * ) Notice: Subject to any disclaimer, the term of this patent is extended or adjusted under 35 U.S.C. 154(b) by 0 days.

(21) Appl. No.: 11/458,022

(22) Filed: Jul. 17, 2006

Related U.S. Application Data

(60) Provisional application No. 60/804,193, filed on Jun. 8, 2006.

(51) Int. Cl.
*H01Q 1/10* (2006.01)

(52) U.S. Cl. ..... 343/901; 343/702

(58) Field of Classification Search ..... 343/900, 343/901, 903, 906, 702, 752
See application file for complete search history.

(56) References Cited

U.S. PATENT DOCUMENTS 6,239,754 B1 * 5/2001 Kim ..... 343/702
6,317,086 B1 * 11/2001 Woo ..... 343/702
6,608,606 B1 * 8/2003 Chang ..... 343/702
6,992,642 B2 1/2006 Goldman et al.

* cited by examiner

*Primary Examiner*—Thuy V. Tran
*Assistant Examiner*—Dieu Hien T Duong
(74) *Attorney, Agent, or Firm*—Holland & Hart LLP

(57) ABSTRACT

A retractable antenna having an elongated radiating element with an upper portion and a lower portion is provided. A slide tube is coupled to the lower portion such that the elongated radiating element is movable with respect to the slide tube. A compressible contact is provided on a bottom portion of the lower portion. The compressible contact is compressed by an inner sidewall of the slide tube at least when the elongated radiating element is in the extended position to facilitate maintaining the elongated radiating element in the extended position and provide an electrical connection between the elongated radiating member and the slide tube.

20 Claims, 2 Drawing Sheets

TELESCOPIC RETRACTABLE ANTENNA

RELATED APPLICATIONS

This application claims the benefit of U.S. Provisional Patent Application Ser. No. 60/804,193, filed Jun. 8, 2006, titled TELESCOPIC RETRACTABLE ANTENNA, the disclosure of which is incorporated herein as if set out in full.

FIELD OF THE INVENTION

The present invention relates to antennas and, more particularly, to a telescopic element with an compressible and expandable contact.

BACKGROUND OF THE INVENTION

Wireless communication devices are widespread throughout many industries today. Pressure on the industry is to make the devices more efficient, economical, and generally smaller. The antenna is one essential feature of the wireless communication device. Many devices today use retractable antennas. Thus, improvements to the electrical and mechanical features of the retractable antenna are desired.

One telescopic, retractable antenna is described in U.S. Pat. No. 6,992,642, titled Telescopic Retractable Antenna with Improved Contact System, issued Jan. 31, 2006, and incorporated herein by reference. While the '642 patent describes an improvement over some telescopic elements, its overall characteristics make is a less than desirable antenna design.

SUMMARY OF THE INVENTION

The present invention provides a retractable antenna. The retractable antenna an elongated radiating element having an upper portion and a lower portion. A slide tube having an inner sidewall is coupled to a lower portion of the elongated radiating element such that the slide tube is movable relative extended position. A contact comprising a holder and a compressible portion is fixedly coupled to a bottom portion of the elongated radiating element and electrically connected to the elongated radiating element. The contact is movable relative to the slide tube. The compressible portion has an upper slide interface and a lower slide interface electrically connected to the holder. At least one of the upper slide interface and the lower slide interface moves in sliding relation to the holder. The upper and lower slide interface are connected by at least one bulging surface, such at least in the extended position, the inner sidewall compresses the bulging surface and provides an electrical connection between the slide tube and the compressible portion to facilitate maintaining the retractable antenna in the extended position and provide an electrical connection between the slide tube and the elongated radiating element.

Utilities and advantages of the invention will be apparent from the following more particular description of a preferred embodiment of the invention as illustrated in the accompanying drawings.

BRIEF DESCRIPTION OF THE DRAWING

The accompanying drawings, which are incorporated in and constitute a part of this specification, illustrate embodiments of the present invention, and together with the description, serve to explain the principles thereof. Like items in the drawings are referred to using the same numerical reference.

DETAILED DESCRIPTION

The present invention will be described with reference to the figures. While the present invention is described with particular reference to a cellular telephone, one of ordinary skill in the art on reading the disclosure will understand that other wireless communication devices may benefit from the present invention. Other devices include, text messaging units, portable computing devices, PDAs, wireless televisions, and the like.

Moreover, while this present application is directed to a retractable, telescopic antenna, one of ordinary skill in the art will recognize on reading the disclosure that the retractable telescopic antenna could be a stand-alone antenna or combined with other antennae on a wireless device. For example, the present antenna structure could be combined with an internal antenna for the wireless device, another external antenna, a GPS antenna, a Bluetooth antenna, or the like. Combining the antenna of the present application with other antennas is dependent, in part, on the desired functionality of the wireless device.

Figures 1, 2, 3, 4:
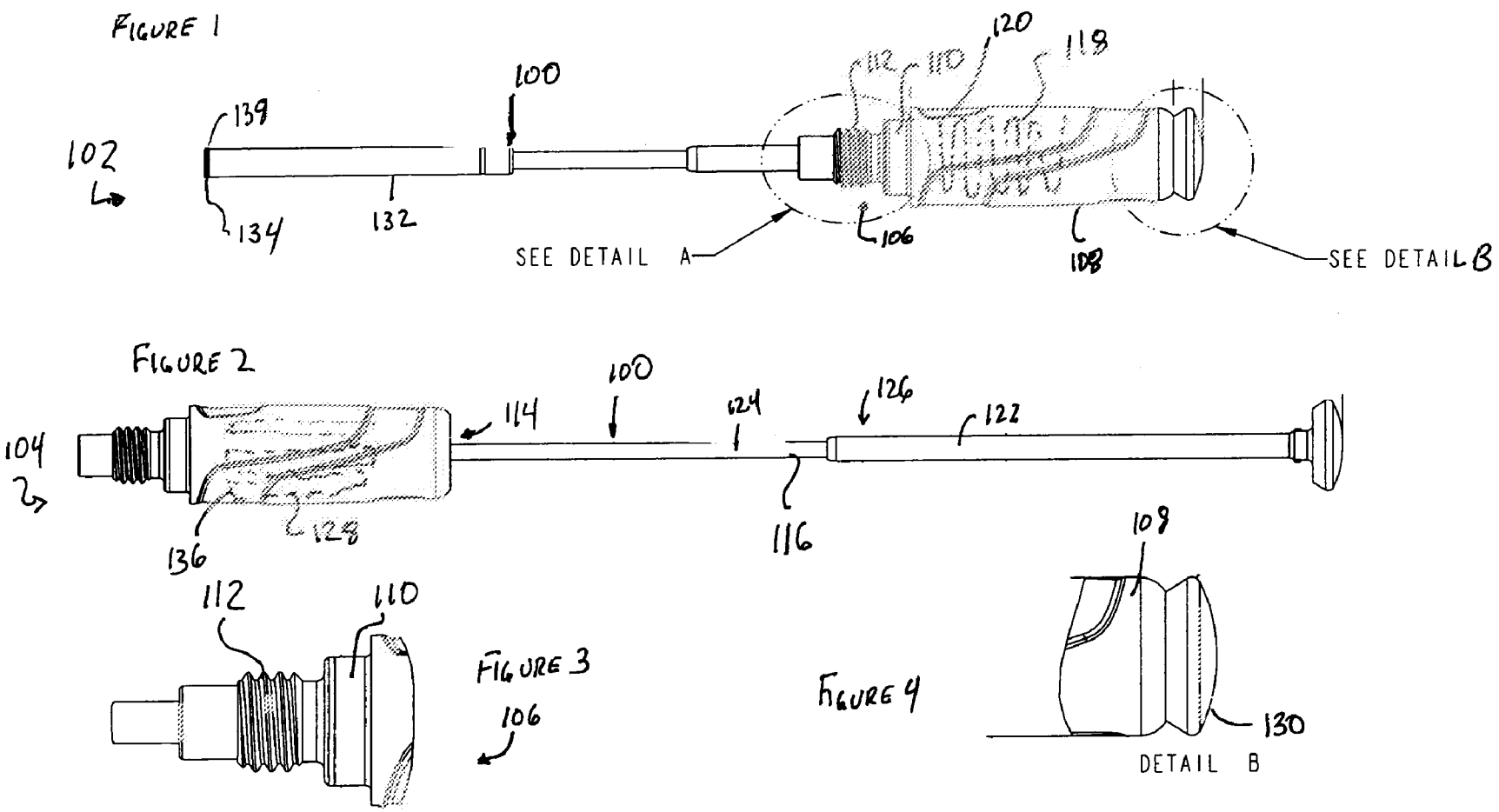
FIG. 1 shows a side elevation view of an antenna in a retracted position constructed in accordance with an embodiment of the present invention.
FIG. 2 shows a side elevation of the antenna in FIG. 1 in an extended position.
FIG. 3 shows a side elevation of the connector of FIG. 1 in more detail.
FIG. 4 shows a side elevation of the cap of FIG. 1 in more detail.

FIGS. 1 and 2, a retractable antenna 100 is shown. In FIG. 1, antenna 100 is shown in a retracted position 102. FIG. 2 shows antenna 100 in an extended position 104. Antenna 100 includes a connector 106 coupled to an overmolded antenna housing 108. Connector 106 is shown as a bushing 110 having threads 112. Threads 112 would couple to corresponding threads on the wireless communication device housing (not specifically shown). FIG. 3 shows a detail of connector 106. Overmolded antenna housing 108 has a channel 114 through which retractable whip 116 slidably moves. Overmolded housing 108 contains an antenna element 118, shown in phantom in FIG. 1. Antenna element 118 may be any radiating element, but is typically, a helical antenna element. Other radiating elements may be used, however, such as, for example, a meander antenna element or the like. Antenna element 118 is coupled to RF power in any conventional manner at feed point 120.

Whip 116 has an upper portion 122 and a lower portion 124. Whip 116 is generally contained in an insulative sheath 126. Upper portion 122 generally has a greater diameter than lower portion 124. Arranging upper portion 122 with a larger diameter provides a frictional engagement with a contact 128 (shown in phantom in FIG. 2) in overmolded antenna housing 108. The frictional engagement facilitates maintaining the antenna in retracted position 102.

Upper portion 122 of whip 116 terminates in a cap 130. Cap 130 provides an interference fit with overmolded antenna housing 108 in the retracted position and provides a mechanism to allow a user to extend and retract the antenna 100.

As seen in FIG. 1, lower portion 124 is partially contained in slide tube 132. Slide tube 132 in the extended position would frictionally engage contact 128 in overmolded antenna housing 108 to provide a frictional engagement to facilitate maintaining antenna 100 in the extended position. Slide tube 132 terminates in a bottom stop 134, which may be integral with slide tube 132 or a separate part press fit or the like into slide tube 132. Bottom stop 134 would have a flanged portion 138 that engages bottom edge 136 of contact 128 to inhibit slide tube 132 and antenna 100 from pulling out of overmolded antenna housing 108. Bottom edge 136 could be arranged as a protrusion in overmolded antenna housing 108 as a matter of design choice. RF power is supplied to whip 116 via contact 128, which is connected to RF power in any conventional manner, contacting slide tube 132.

Figure 5:
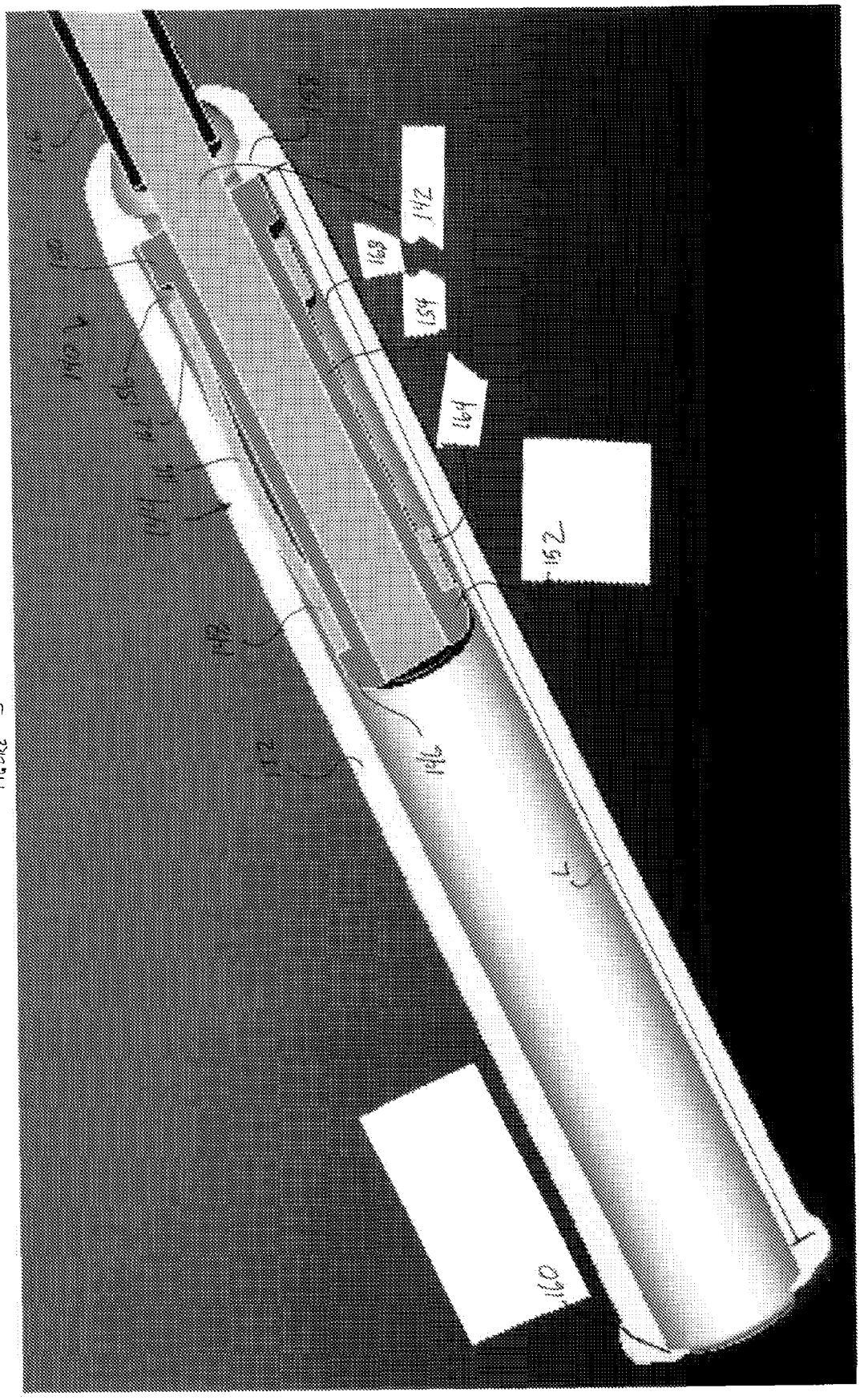
FIG. 5 shows a cross-sectional view of a bottom portion and slide tube associated of the antenna of FIG. 1 in the extended position of FIG. 2.

Referring now to FIG. 5, a bottom portion 140 of whip 116 and slide tube 132 is shown in cross-section and in more detail. A bottom portion 140 of lower portion 124 is not covered by insulating sheath 126 such that radiating element 142 is exposed. A contact 144 is coupled to the radiating element 142. Contact 144 is slidably arranged in slide tube 132 and moveable along a length L of slide tube 132. Contact 144 comprises a holder 146 and a compressible portion 148. Holder 146 is substantially in electrical contact with radiating element 142 and compressible portion 148. Holder 146 is generally shaped to surround radiating element 148 and has an upper lip 150 and a lower lip 152. Upper lip 150 and lower lip 152 are connected by a holder sidewall 154 and all define a generally enclosed recess 156. Compressible portion 148 resides in recess 156 and is arranged such that compressible portion 148 can move in sliding relation to recess 156 along holder sidewall 154, which will be explained further below. Upper lip 150 and lower lip 152 may abut upper and lower flanges 158 and 160 on slide tube 132. The abutment of upper lip 150 and upper flange 158 or lower lip 152 and lower flange 160 inhibit separation of whip 116 and slide tube 132.

Compressible portion 148 has an upper slide interface 162 and a lower slide interface 164 in slidable contact with holder sidewall 146. While both interfaces 162 and 164 are described as slidable, only one of the two in fact needs to be capable of movement. Extending between interfaces 162 and 164 is at least one bulging surface 166. Bulging surface 166 is referred to as bulging because at least in the non-compressed state, surface 166 bulges beyond recess 156. Generally, in retracted position 104, bulging surface 166 is not compressed significantly, or ideally not at all for wear considerations. When in extended position 102, however, bulging surface 166 would be compressed by inner wall 168 of slide tube 132. Compressing bulging surface 166 causes one or both of sliding interfaces 162 and 164 to move along holder sidewall 154. Compressing bulging surface 166 facilitates a frictional engagement between slide tube 132 and whip 116 to facilitate maintaining whip 116 in extended position 102.

To facilitate compression of bulging surface 166, slide tube 132 may be constructed with an inner diameter D substantially near the upper portion of slide tube 132. Diameter D should be less than the non-compressed diameter of compressible portion 148. While the inner diameter D of slide tube 132 may be consistent along a majority of slide tube 132, this would essentially provide a frictional engagement between contact 144 and sidewall 146 along the entire length of slide tube 132. To reduce the frictional wear, slide tube may have an inner diameter D' along a majority of its lower portion. Inner diameter D' would be greater than D and ideally greater than the diameter of compressible portion 148 in the non-compressed state. In either case, slide tube 132 may comprise a reduced diameter portion 500 (preferably a taper to facilitate compression of contact 144 or a step) to form a chamber 502 that substantially holds contact 144 in the extended position.

While the invention has been particularly shown and described with reference to an embodiment thereof, it will be understood by those skilled in the art that various other changes in the form and details may be made without departing from the spirit and scope of the invention.

The invention claimed is:

1. A retractable antenna, comprising:

an elongated radiating element having an upper portion and a lower portion;

a slide tube having an inner sidewall coupled to a lower portion of the elongated radiating element, the slide tube is movable relative to the elongated radiating element between a retracted position and an extended position;

a contact comprising a holder and a compressible portion;

the holder fixedly coupled to a bottom portion of the elongated radiating element and electrically connected to the elongated radiating element, the contact is movable relative to the slide tube; and the compressible portion comprising an upper slide interface and a lower slide interface electrically connected to the holder, at least one of the upper slide interface and the lower slide interface moves in sliding relation to the holder, the upper and lower slide interface connected by at least one bulging surface, such at least in the extended position, the inner sidewall compresses the bulging surface and provides an electrical connection between the slide tube and the compressible portion to facilitate maintaining the retractable antenna in the extended position and provide an electrical connection between the slide tube and the elongated radiating element.

2. The retractable antenna of claim 1, wherein the holder comprises:

an upper lip;

a lower lip; and a holder sidewall extending between the upper lip and lower lip forming a recess, wherein the compressible portion is contained in the recess between the upper lip and lower lip.

3. The retractable antenna of claim 2, wherein the bulging surface extends beyond the recess.

4. The retractable antenna of claim 1, wherein the slide tube has an inner diameter, at least at an upper portion of the slide tube, less than a non-compressed diameter of the compressible portion.

5. The retractable antenna of claim 4, wherein a majority of the slide tube has an inner diameter less than a non-compressed diameter of the compressible portion.

6. The retractable antenna of claim 4, wherein a lower portion of the slide tube has an inner diameter greater than a non-compressed diameter of the compressible portion.

7. The retractable antenna of claim 6, wherein moving the elongated radiating member from the retracted position to the extended position causes the inner sidewall to compress the compressible portion which causes the upper slide interface and the lower slide interface to move apart relative to each other.

8. The retractable antenna of claim 4, wherein the slide tube further comprises a reduced diameter section between the upper portion and a lower portion, the reduced diameter section.

9. The retractable antenna of claim 8, wherein the reduced diameter section is tapered.

10. The retractable antenna of claim 8, wherein the reduced diameter section is stepped.

11. A retractable antenna, comprising:

a connector to connect the retractable antenna to a housing of a wireless device;

an overmolded housing coupled to the connector;

a bore extending through the connector and overmolded housing an elongated radiating element extending through the bore and movable within the bore from a retracted position to an extended position, the elongated radiating element having an upper portion and a lower portion; the elongated radiating element movable with respect to the bore;

a slide tube having an inner sidewall coupled to a lower portion of the elongated radiating element, the slide tube is movable relative to the elongated radiating element between a retracted position and an extended position;

the slide tube movable into the bore to form a fricational engagement when the retractable antenna is in the extended position;

a first contact in the overmolded housing removably electrically connected to the slide tube, wherein the first contact is electrically connected to the slide tube when the slide tube is in the bore;

a second contact comprising a holder and a compressible portion;

the holder fixedly coupled to a bottom portion of the elongated radiating element and electrically connected to the elongated radiating element, the second contact is movable relative to the slide tube; and the compressible portion comprising an upper slide interface and a lower slide interface electrically connected to the holder, at least one of the upper slide interface and the lower slide interface moves in sliding relation to the holder, the upper and lower slide interface connected by at least one bulging surface, such at least in the extended position, the inner sidewall compresses the bulging surface and provides an electrical connection between the slide tube and the compressible portion to facilitate maintaining the retractable antenna in the extended position and provide an electrical connection between the slide tube and the elongated radiating element.

12. The retractable antenna of claim 11, further comprising a second radiating element in the overmolded housing electrically connected to the first contact.

13. The retractable antenna of claim 12, wherein the second radiating element comprises a helical element.

14. The retractable antenna of claim 12, wherein the second radiating element comprises a meander element.

15. The retractable antenna of claim 11, wherein the holder comprises:

an upper lip;

a lower lip; and a holder sidewall extending between the upper lip and lower lip forming a recess, wherein the compressible portion is contained in the recess between the upper lip and lower lip.

16. The retractable antenna of claim 11, wherein the slide tube has an inner diameter, at least at an upper portion of the slide tube, less than a non-compressed diameter of the compressible portion.

17. The retractable antenna of claim 11, wherein the upper portion of the elongated radiating element has a larger diameter than the lower portion such that the elongated radiating element forms a frictional engagement with the bore in the retracted position.

18. A wireless device, comprising:

a housing; and at least one telescopic, retractable antenna;

the at least one telescopic, retractable antenna comprising:

an elongated radiating element having an upper portion and a lower portion;

a slide tube having an inner sidewall coupled to a lower portion of the elongated radiating element, the slide tube is movable relative to the elongated radiating element between a retracted position and an extended position;

a contact comprising a holder and a compressible portion;

the holder fixedly coupled to a bottom portion of the elongated radiating element and electrically connected to the elongated radiating element, the contact is movable relative to the slide tube; and the compressible portion comprising an upper slide interface and a lower slide interface electrically connected to the holder, at least one of the upper slide interface and the lower slide interface moves in sliding relation to the holder, the upper and lower slide interface connected by at least one bulging surface, such at least in the extended position, the inner sidewall compresses the bulging surface and provides an electrical connection between the slide tube and the compressible portion to facilitate maintaining the retractable antenna in the extended position and provide an electrical connection between the slide tube and the elongated radiating element.

19. The wireless device of claim 18, further comprising an internal antenna contained in the housing.

20. The wireless device of claim 18, wherein the wireless device is selected from the group of wireless devices consisting of: cellular telephones, two-way radios, PDAs, pagers, desktop computers, laptop computers, handheld computers, televisions, or electronic games.

* * * * *